US007242158B2

(12) United States Patent
Whitham et al.

(10) Patent No.: US 7,242,158 B2
(45) Date of Patent: Jul. 10, 2007

(54) DISTRIBUTED RF SOURCES FOR MEDICAL RF ACCELERATOR

(75) Inventors: Kenneth Whitham, Alamo, CA (US); H. George Hammon, III, Orinda, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 361 days.

(21) Appl. No.: 10/887,618

(22) Filed: Jul. 8, 2004

(65) Prior Publication Data

US 2006/0006809 A1 Jan. 12, 2006

(51) Int. Cl.
*H05H 9/00* (2006.01)

(52) U.S. Cl. ..... 315/505; 315/500; 315/5.42

(58) Field of Classification Search ..... 315/500, 315/505, 5.41, 5.42, 39
See application file for complete search history.

(56) References Cited

U.S. PATENT DOCUMENTS

| | | | | |
|---|---|---|---|---|
| 4,027,193 | A * | 5/1977 | Schriber | 315/5.41 |
| 4,118,652 | A * | 10/1978 | Vaguine | 315/5.41 |
| 4,713,581 | A * | 12/1987 | Haimson | 315/5.41 |
| 4,780,647 | A * | 10/1988 | Friedman et al. | 315/5.41 |
| 5,084,682 | A * | 1/1992 | Swenson et al. | 315/505 |
| 5,744,919 | A * | 4/1998 | Mishin et al. | 315/505 |
| 6,724,261 | B2 * | 4/2004 | Cheo | 330/295 |
| 6,856,105 | B2 * | 2/2005 | Yao et al. | 315/505 |
| 7,005,809 | B2 * | 2/2006 | Whitham et al. | 315/500 |
| 2005/0057198 | A1 * | 3/2005 | Hanna | 315/500 |

* cited by examiner

*Primary Examiner*—Haissa Philogene

(57) ABSTRACT

Some embodiments include an accelerator waveguide having a plurality of cavities, and at least two RF power sources, each of the at least two RF power sources being separately coupled to a respective one of the plurality of cavities.

20 Claims, 7 Drawing Sheets

DISTRIBUTED RF SOURCES FOR MEDICAL RF ACCELERATOR

BACKGROUND

1. Field

The embodiments described herein relate generally to particle accelerators. More particularly, the described embodiments relate to particle accelerators including more that one RF power source.

2. Description

A particle accelerator produces charged particles having particular energies. In one common application, a particle accelerator produces a radiation beam used for medical radiation therapy. The beam may be directed toward a target area of a patient in order to destroy cells within the target area by causing ionizations within the cells or by other radiation-induced cell damage.

A conventional particle accelerator includes a particle source, an accelerator waveguide and an RF (radio-frequency) power source. The particle source may comprise an electron gun that generates and transmits electrons to the waveguide. The RF power source, which may comprise a magnetron or a klystron, delivers an electromagnetic wave to a window built into the waveguide. The electromagnetic wave enters the waveguide through the window and oscillates within the waveguide. The oscillations accelerate the transmitted electrons through the waveguide.

The accelerator waveguide may include cavities that are designed to ensure synchrony between electrons received from the particle source and the oscillating electromagnetic wave received from the RF power source. More particularly, the cavities are designed and fabricated so that electric currents flowing on their surfaces generate electric fields that are suitable to accelerate the electrons. The oscillation of these electric fields within each cavity is delayed with respect to an upstream cavity so that an electron is further accelerated as it arrives at each cavity.

Conventional particle accelerators may require large amounts of power and bulky equipment to achieve the foregoing operation. Systems are desired that may provide advantages over conventional particle accelerators, whether in terms of size, weight, efficiency, and/or any other metric.

SUMMARY

In order to address the foregoing, some embodiments provide a system, method, apparatus, and means to provide power to at least two RF power sources, each of the at least two RF power sources being separately coupled to a respective one of a plurality of cavities of an accelerator waveguide, and to inject charged particles into the accelerator waveguide.

Some embodiments provide an accelerator waveguide having a plurality of cavities, and at least two RF power sources, each of the at least two RF power sources being separately coupled to respective ones of the plurality of cavities.

The appended claims are not limited to the disclosed embodiments, however, as those in the art can readily adapt the descriptions herein to create other embodiments and applications.

BRIEF DESCRIPTION OF THE DRAWINGS

Embodiments will become readily apparent from consideration of the following specification as illustrated in the accompanying drawings, in which like reference numerals designate like parts, and wherein.

DETAILED DESCRIPTION

The following description is provided to enable a person in the art to make and use some embodiments and sets forth the best mode contemplated by the inventors for carrying out some embodiments. Various modifications, however, will remain readily apparent to those in the art.

Figure 1:
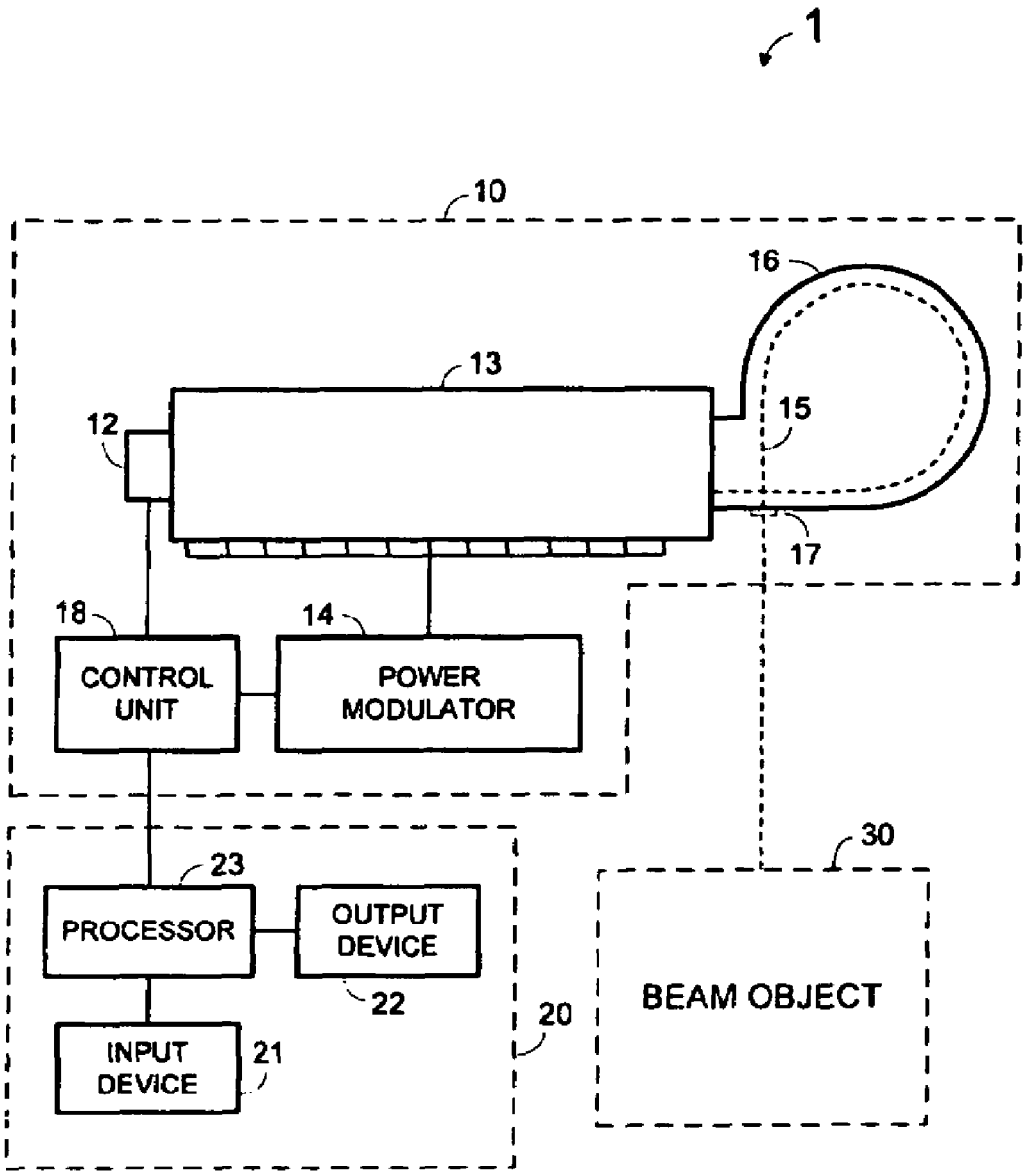
FIG. 1 is block diagram depicting a particle accelerator system according to some embodiments.

FIG. 1 is a block diagram of system 1 according to some embodiments. System 1 includes particle accelerator 10, operator console 20 and beam object 30. System 1 may be used to generate x-rays for use in medical radiation treatment. System 1 may be employed in other applications according to some embodiments.

Particle accelerator 10 may output particles toward beam object 30 in response to commands received from operator console 20. Particle accelerator 10 includes particle source 12 for injecting particles such as electrons into accelerator waveguide 13. Particle source 12 may comprise a heater, a cathode (thermionic or other type), a control grid (or diode gun), a focus electrode and an anode. Accelerator waveguide 13 may include a "buncher" section of cavities that operate to bunch the electrons and a second set of cavities to accelerate the bunched electrons. Some embodiments of particle accelerator 10 may include a prebuncher for receiving particles from particle source 12 and for bunching the electrons before the electrons are received by accelerator waveguide 13.

Power modulator 14 may comprise any suitable currently- or hereafter-known pulsed power source. Power modulator 14 may provide power to RF power sources (not shown) disposed within accelerator waveguide 13. According to some embodiments, at least two RF power sources are separately coupled to a respective cavity of accelerator waveguide 13. For example, an RF power source may be disposed within one cavity of waveguide 13, and a second RF power source may be disposed within a second cavity of waveguide 13. Power modulator 14 may also provide power to particle source 12.

In one example of operation according to some embodiments, the RF power sources generate an electromagnetic wave within accelerator waveguide 13 and waveguide 13 receives electrons from particle source 12. The buncher section prepares the electrons for subsequent acceleration by a second portion of waveguide 13. In particular, the buncher may include tapered cavity lengths and apertures so that the phase velocity and field strength of the electromagnetic wave begin low at the input of the buncher and increase to values that are characteristic to the accelerating portion. Typically, the characteristic phase velocity is equal to the velocity of light. As a result, the electrons gain energy and are bunched toward a common phase as they travel through the buncher.

Accelerator waveguide 13 may output beam 15 to bending magnet 16. Beam 15 includes a stream of electron bunches having a particular energy and bending magnet 16 comprises an evacuated envelope to bend beam 15 two hundred seventy degrees before beam 15 exits bending magnet 16 through window 17. Other bending angles may be used. Beam 15 is received by beam object 30, which may comprise a patient, a target for generating x-rays, or another object. Some embodiments of system 1 do not employ a bending magnet.

Control unit 18 may control an injection voltage and beam current of particle source 12, and/or an amount of power delivered to the RF sources by power modulator 14. Such control may allow accelerator 10 to output a radiation beam having selectable characteristics, such as energy, dose rate, etc. In some embodiments, control unit 18 controls power modulator 14 to provide no power to one of the RF power sources while providing power to other ones of the RF power sources. Control unit 18 may control elements 12 and/or 14 based on instructions received from operator console 20.

Operator console 20 includes input device 21 for receiving instructions from an operator and processor 22 for responding to the instructions. Operator console 20 communicates with the operator via output device 22, which may be a monitor for presenting operational parameters and/or a control interface of particle accelerator 10. Output device 22 may also present images of beam object 30 to confirm proper delivery of beam 15 thereto.

Figure 2:
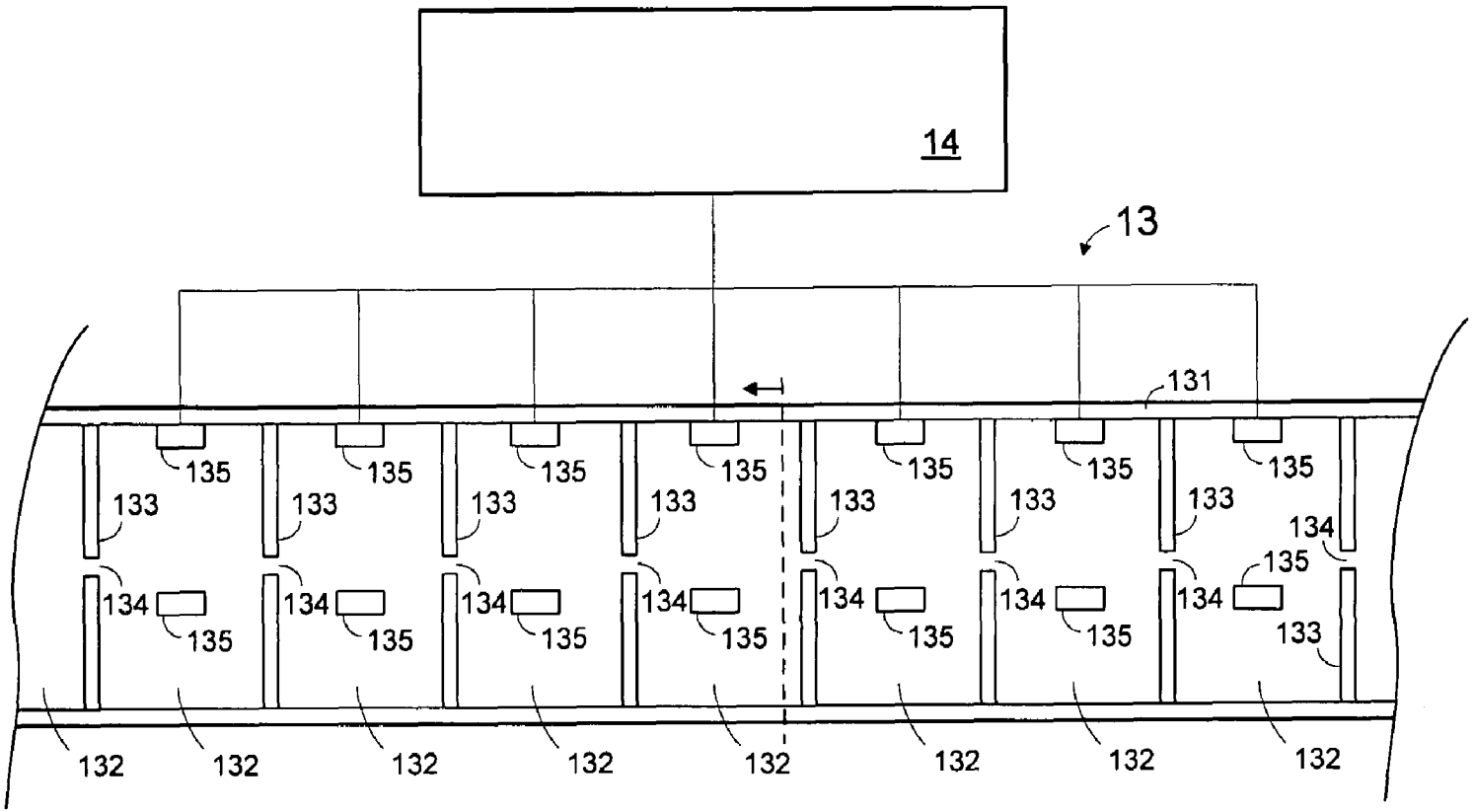
FIG. 2 is a cutaway side view of a portion of an accelerator waveguide according to some embodiments.

FIG. 2 is a cutaway side view of accelerator waveguide 13 according to some embodiments. An interior of wall 131 may be coated with an electrical conductor such as copper. Accelerator waveguide 13 includes a plurality of cylindrical primary cavities 132 disposed along a central axis. Cavities 132 are separated from one another by discs 133, each of which defines center hole 134 for passing a beam through accelerator waveguide 13.

Primary cavities 132 are arranged and formed to accelerate particles along waveguide 13. A first few primary cavities of accelerator waveguide 13 may operate as a buncher to increase a phase velocity of the particle bunches to that of the received RF power. Once the two velocities are synchronized, the particle bunches will pass through each successive cavity during a time interval when the electric field intensity in the cavity is at or near a maximum. Each of cavities 132 may be designed and constructed to exhibit a particular resonant frequency in order to ensure that the particle bunches pass through each cavity during this time interval. The design and arrangement of these cavities are known to those in the art. Other currently- or hereafter-known accelerator waveguide designs, including but not limited to those employing side cavities, may be used in conjunction with some embodiments.

Each of RF power sources 135 is shown separately coupled to a respective one of cavities 132. Each of RF power sources 135 is also coupled to power modulator 14 to receive power as described above. RF power sources 135 deliver RF power to waveguide 13 based on power received from power modulator 14. The illustrated electrical connections between RF power sources 135 and power modulator 14 may be manufactured integrally with waveguide 13 or may be inserted into waveguide 13 through openings that are thereafter sealed such that a vacuum may be maintained within waveguide 13.

Figure 3:
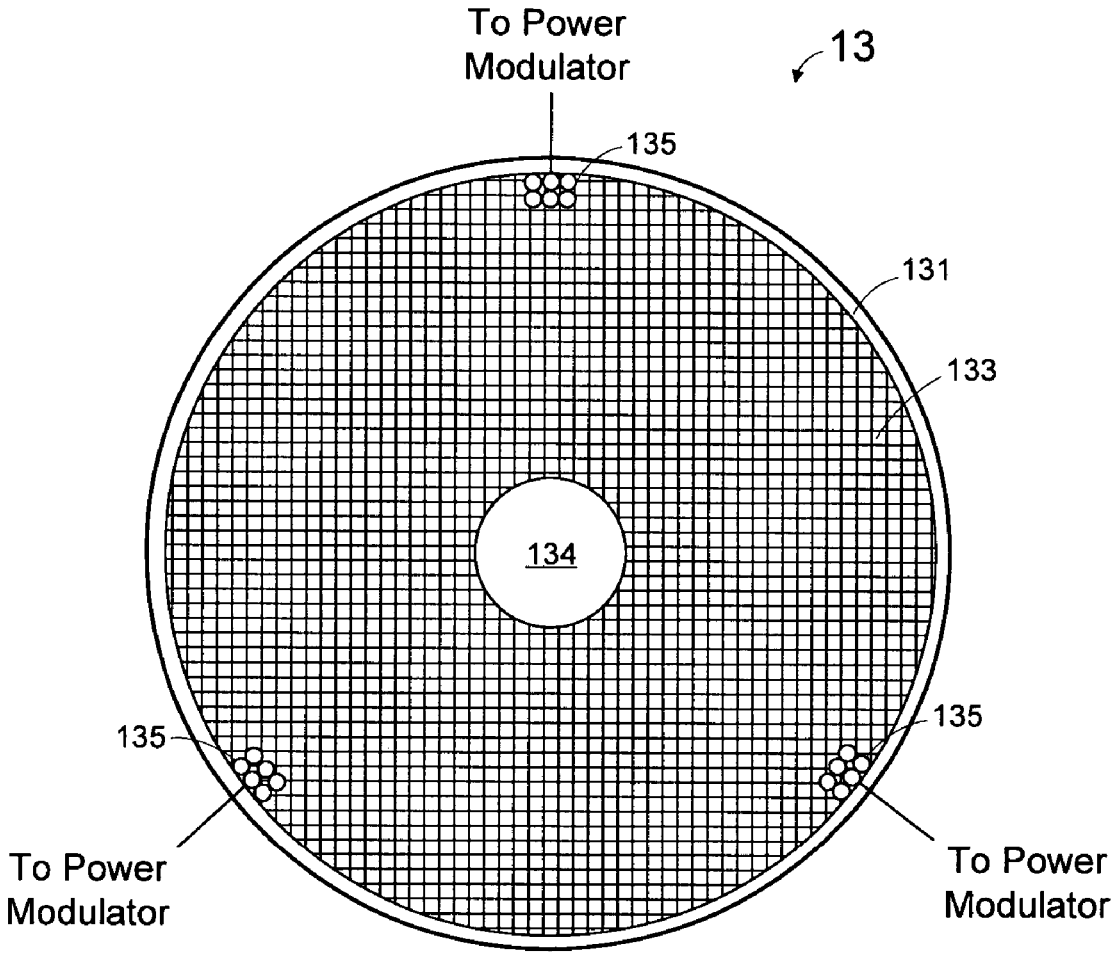
FIG. 3 is a cutaway end view of an accelerator waveguide according to some embodiments.

FIG. 3 is a cutaway end view of accelerator waveguide 13 of FIG. 2. The location of the cutaway and direction of the view are indicated by the dashed line and arrow of FIG. 2. FIG. 3 shows outer wall 131, disc 133 and center hole 134 formed by disc 133. Center hole 134 shares an axis with center holes defined by each other disc 133 of accelerator waveguide 13.

FIG. 3 also shows three RF power sources 135 directly coupled to the illustrated cavity. Some embodiments may include more or fewer RF power sources 135 separately coupled to each cavity 132 of accelerator waveguide 13. Each illustrated power source 135 comprises a cluster of six planar triodes.

RF power sources 135 may comprise individual and/or clusters of planar triodes according to some embodiments. Other suitable currently- or hereafter-known RF power sources may be used in conjunction with some embodiments. Having RF power sources separately coupled to at least two different accelerator cavities may allow for a lighter, smaller and/or less power-consuming particle accelerator than previously available.

Figure 4:
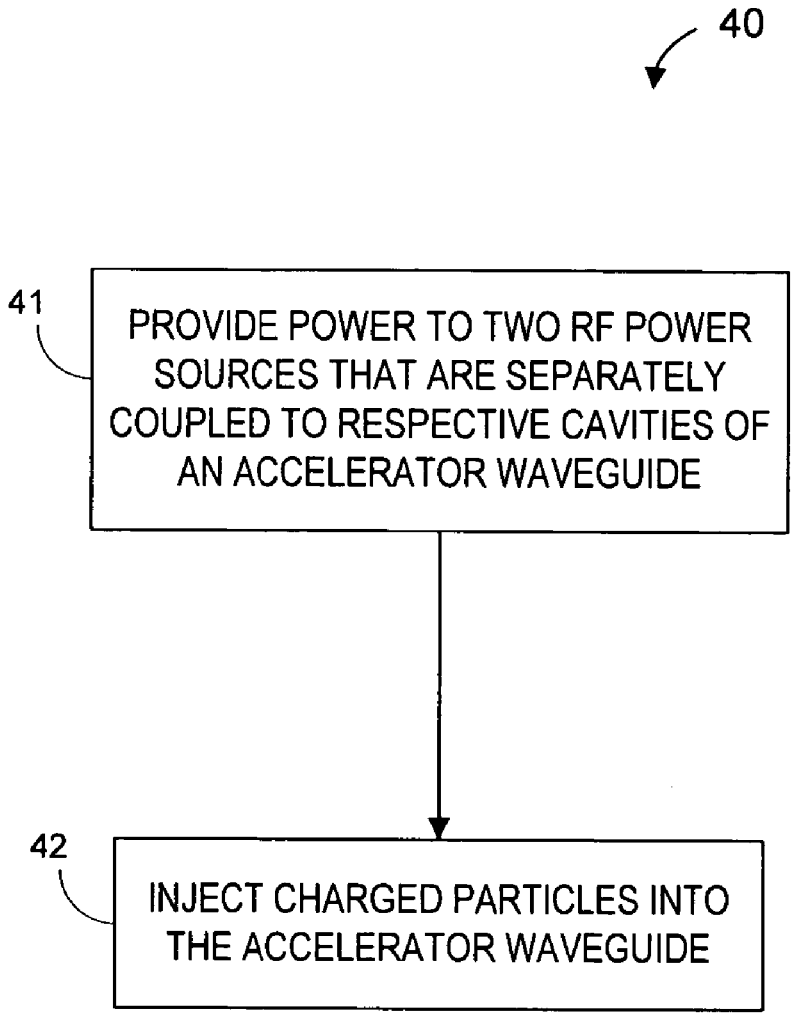
FIG. 4 is a flow diagram of process steps pursuant to some embodiments.

FIG. 4 is a flow diagram of process steps 40 according to some embodiments. Process steps 40 may be executed by one or more elements of particle accelerator 10, operator console 20, and other devices. Accordingly, process steps 40 may be embodied in hardware and/or software. Process steps 40 will be described below with respect to the above-described elements, however it will be understood that process steps 40 may be implemented and executed differently than as described below.

Prior to step 41, particle accelerator 10 may receive a command from operator console 20 to output particles having particular characteristics. In response, power modulator 14 provides power to at least two RF power sources 135 that are separately coupled to respective cavities of an accelerator waveguide 13. For example, power modulator 14 may provide power at 41 to each RF power source 135 of accelerator waveguide 13.

In some embodiments of 41, power modulator 14 provides power to less than all of RF power sources 135 of waveguide 13. Control unit 18 may instruct power modulator 14 as to which RF power sources 135 are to receive power in accordance with the desired particle characteristics. The RF power sources 135 which receive power then provide RF power to accelerator waveguide 13. The RF power generates electric fields within each cavity 132 of waveguide 13.

Next, at 42, particles are injected into accelerator waveguide 14. Control unit 18 may control an injection voltage and beam current of particle source 12 at 42 based on the desired particle characteristics. As described above, the injected particles are accelerated by the electric fields generated within waveguide 13.

In some embodiments, the power delivered to the RF power sources 135 at 41 is phase-related to achieve suitable acceleration within each cavity 132. The phase relation may be accomplished by power modulator 14 and/or by the electrical connections between power modulator 14 and RF power sources 135. In a case that RF power sources function as oscillators, a suitable pre-pulse may be provided to one or more of RF power sources 135 to establish a proper phase relation between RF power sources 135.

Figure 5:
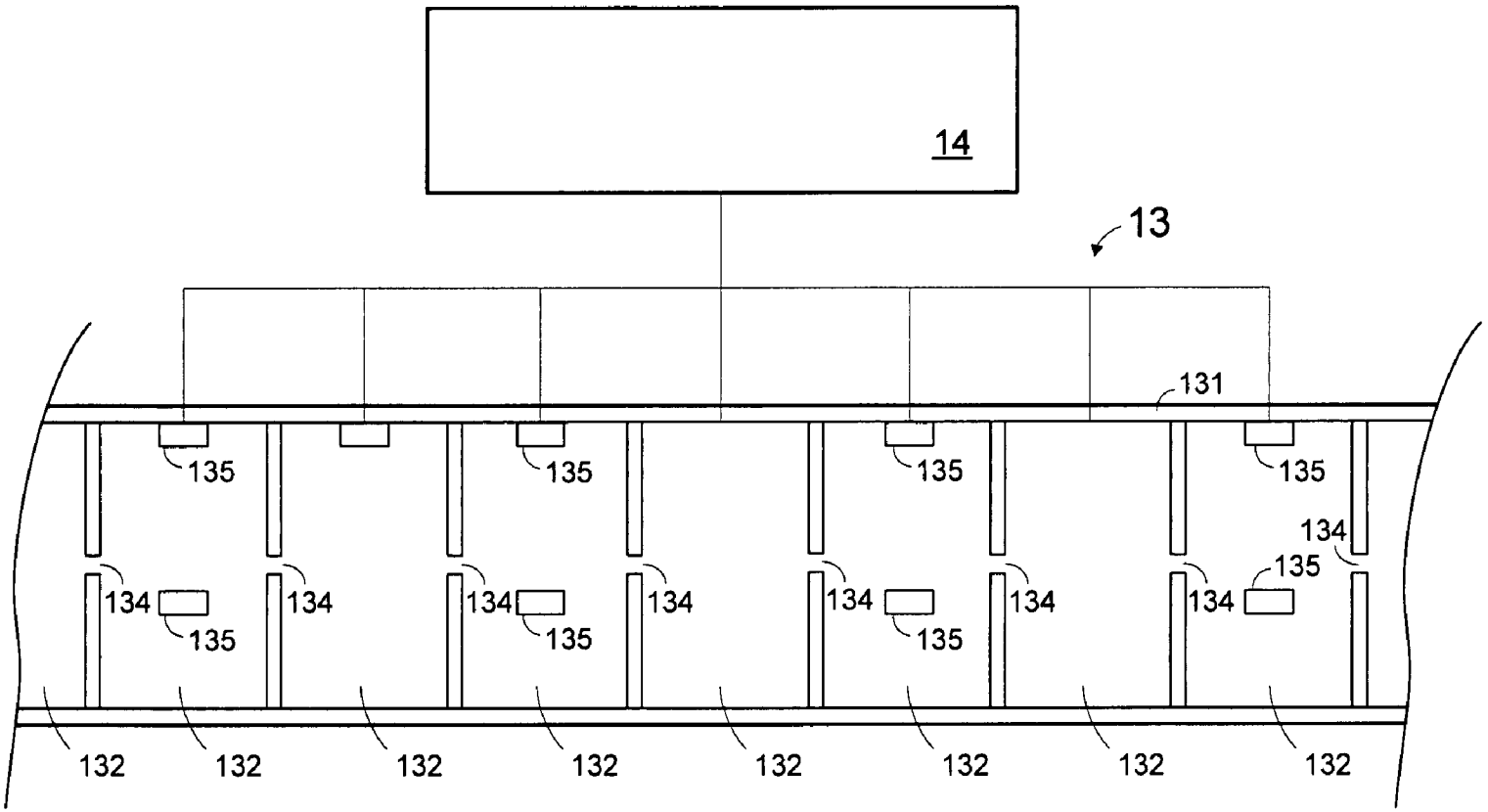
FIG. 5 is a cutaway side view of an accelerator waveguide according to some embodiments.

FIG. 5 is a cutaway side view of accelerator waveguide 13 according to some embodiments. Accelerator waveguide 13 of FIG. 5 is identical to waveguide 13 of FIG. 2 except for the omission of RF power sources 135 in every other cavity 132. Accelerator waveguide 13 of FIG. 5 may be used to implements process steps 40 according to some embodiments. Any other arrangements of at least two RF power sources 135 separately coupled to two different cavities 132 may be used in conjunction with some embodiments.

Figure 6:
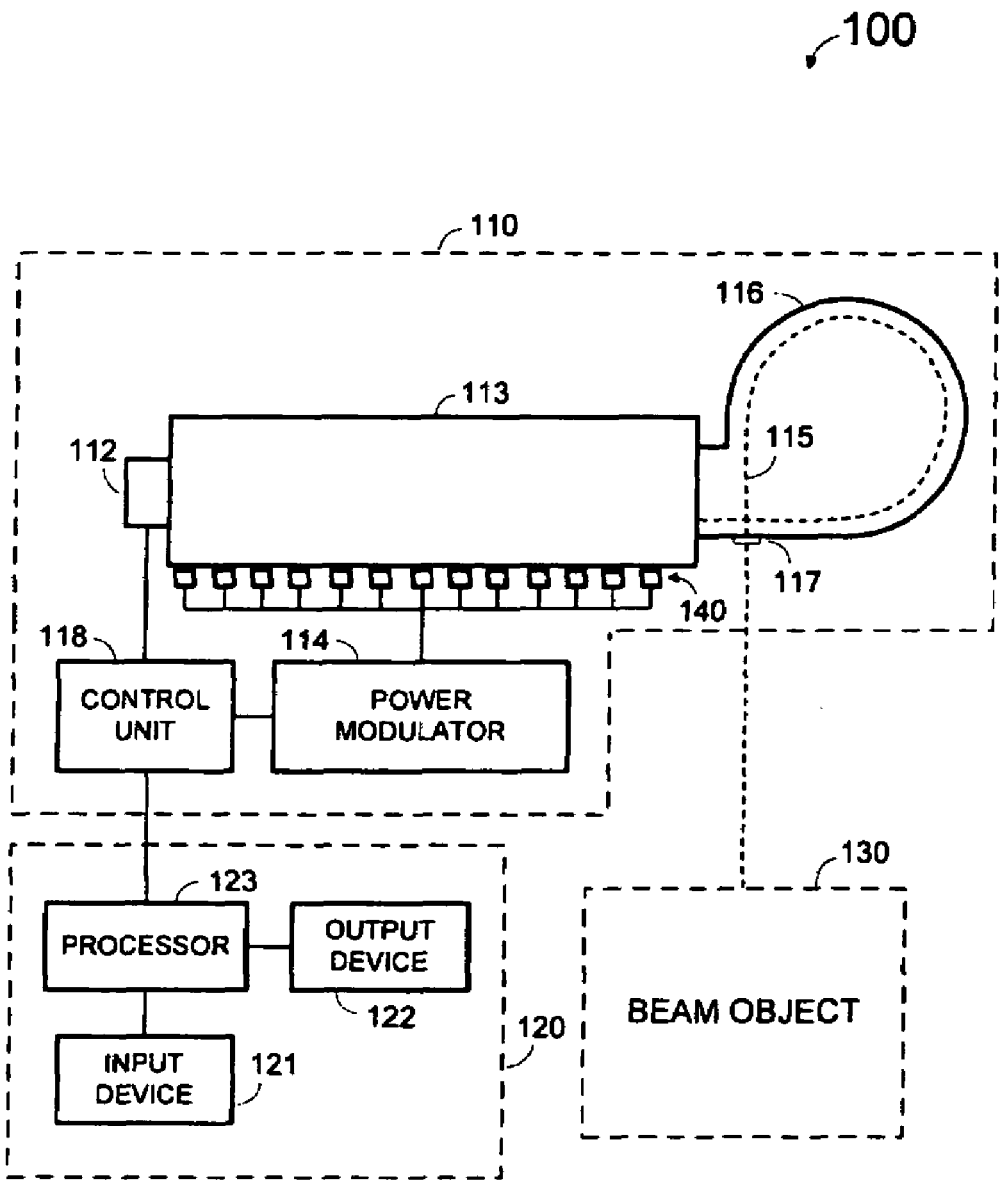
FIG. 6 is block diagram depicting a particle accelerator system according to some embodiments.

FIG. 6 is a block diagram of system 100 according to some embodiments. System 100 includes particle accelerator 110, operator console 120 and beam object 130. The elements of system 100 labeled as 1XX may operate as described above with respect to corresponding elements labeled XX.

System 100 includes RF power sources 140 disposed external to accelerator waveguide 113. At least two of RF power sources 140 are separately coupled to two different cavities of waveguide 113. According to some embodiments, each of RF power sources 140 is coupled to a respective cavity via a coupling slot (not shown).

Figure 7:
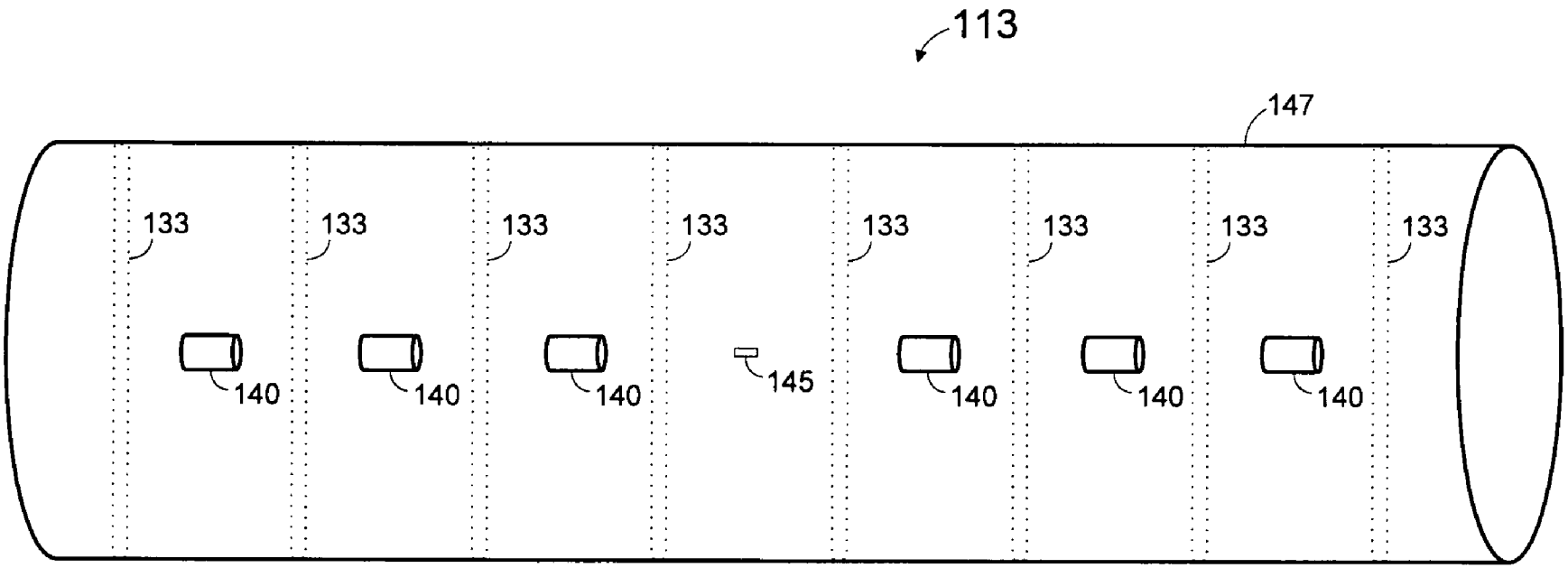
FIG. 7 is a side view of a portion of an accelerator waveguide according to some embodiments.

FIG. 7 is a side view of waveguide 113 according to some embodiments. Waveguide 113 may share the internal construction of waveguide 13 of FIG. 2, with the exception that no RF power sources are disposed within waveguide 113. Rather, RF power sources 140 are disposed external to waveguide 113. The dashed lines of FIG. 7 represent the locations of discs 133 in order to illustrate the relation of RF power sources 140 to the cavities within waveguide 113. As shown, one RF power source 140 is separately coupled to six of the seven illustrated cavities.

Coupling slot 145 is in communication with an internal cavity of accelerator waveguide 113. In operation, coupling slot 145 is also in communication with an RF power source 140, which has been removed to reveal coupling slot 145. Each illustrated RF power source 140 is in communication with a respective one of six other coupling slots, which are obscured by RF power sources 140 in the FIG. 7 view. Such coupling slots facilitate the delivery of RF power from the RF power sources 140 to the interior of accelerator waveguide 113.

Some embodiments may employ other arrangements of coupling slots and external RF power sources. For example, two or more coupling slots may communicate with one cavity, with each of the two or more coupling slots being in communication with a respective RF power source. In some embodiments, one or more cavities of accelerator waveguide 113 are not in direct communication with any coupling slots or RF power sources. According to some embodiments, RF power sources 140 may be external to outer wall 147 of waveguide 113 but may in turn be enclosed by another wall surrounding wall 147. The volume between wall 147 and the other wall may or may not be evacuated during operation.

The several embodiments described herein are solely for the purpose of illustration. Therefore, persons in the art will recognize from this description that other embodiments may be practiced with various modifications and alterations.

What is claimed is:

1. An apparatus comprising:

an accelerator waveguide comprising a plurality of cavities; and

RF power sources, wherein a first one of the two RF power sources is coupled to one of the plurality of cavities, and wherein a second one of the two RF power sources is coupled to a second one of the plurality of cavities.

2. An apparatus according to claim 1, wherein the two RE power sources are disposed within the accelerator waveguide.

3. An apparatus according to claim 2, wherein the first one of the two RF power sources is disposed within the one of the plurality of cavities, and wherein the second one of the two RF power sources is disposed within the second one of the plurality of cavities.

4. An apparatus according to claim 3, wherein the plurality of cavities comprise primary cavities.

5. An apparatus according to claim 2, further comprising;

a third RF power source; and a fourth RF power source, wherein the third RF power source is coupled to the first one of the plurality of cavities, and wherein the fourth RF power source is coupled to the second one of the plurality of cavities.

6. An apparatus according to claim 1, the accelerator waveguide further comprising:

a coupling slot in communication with the one of the plurality of cavities to which one of the first RF power source is coupled, wherein the first RF power source is in communication with the coupling slot and is disposed external to the accelerator waveguide.

7. An apparatus according to claim 6, further comprising;

a third RF power source; and a fourth RF power source, wherein the third RF power source is coupled to the first one of the plurality of cavities, and wherein the fourth RF power source is coupled to the second one of the plurality of cavities.

8. An apparatus according to claim 1, further comprising:

a third RF power source; and a fourth RF power source, wherein the third RF power source is coupled to the first one of the plurality of cavities, and wherein the fourth RF power source is coupled to the second one of the plurality of cavities.

9. An apparatus according to claim 1, wherein each of the two RF power sources comprise one or more planar triodes.

10. An apparatus according to claim 1, the two RF power sources selectively operable to independently generate respective RF power.

11. A method comprising:

providing power to two RF power sources, wherein a first one of the two RF power sources is coupled to a first one of a plurality of cavities of an accelerator waveguide, and wherein a second one of the two RF power sources is coupled to a second one of the plurality of cavities; and injecting charged particles into the accelerator waveguide.

12. A method according to claim 11, wherein the two RF power sources are disposed within the accelerator waveguide.

13. A method according to claim 12, wherein the first one of the two RF power sources is disposed within the first one of the plurality of cavities, and wherein the second one of the two RF power sources is disposed within the second one of the plurality of cavities.

14. A method according to claim 13, wherein the plurality of cavities comprise primary cavities.

15. A method according to claim 12, wherein a third RF power source is coupled to the first one of the plurality of cavities, and wherein a fourth RF power source is coupled to the second one of the plurality of cavities.

16. A method according to claim 11, wherein the accelerator waveguide comprises a coupling slot in communication with the first one of the plurality of cavities to which the first one of the two RF power sources is coupled, and wherein the first one of the two RF power sources is in communication with the coupling slot and is disposed external to the accelerator waveguide.

17. A method according to claim 16, wherein a third RF power source is coupled to the first one of the plurality of cavities, and wherein a fourth RF power source is coupled to the second one of the plurality of cavities.

18. A method according to claim 11, wherein a third RF power source is coupled to the first one of the plurality of cavities, and wherein a fourth RF power source is coupled to the second one of the plurality of cavities.

19. A method according to claim 11, wherein each of the two RF power sources comprise one or more planar triodes.

20. A method according to claim 11, wherein providing power to the two RF power sources comprises:

providing no power to the first one of the two RF power sources and providing power to the second one of the two RF power sources.

* * * * *